US005486737A

United States Patent [19]

Hrubowchak et al.

[11] Patent Number: 5,486,737

[45] Date of Patent: Jan. 23, 1996

[54] HEAVILY LOADED DOUBLE-ENDED ARC LAMP

[75] Inventors: David M. Hrubowchak, Litchfield, N.H.; Nanu Brates, Malden, Mass.

[73] Assignee: Osram Sylvania Inc., Del.

[21] Appl. No.: 226,807

[22] Filed: Apr. 12, 1994

[51] Int. Cl.[6] ..... H01J 61/30

[52] U.S. Cl. ..... 313/634; 313/493

[58] Field of Search ..... 313/634, 493, 313/623

[56] References Cited

U.S. PATENT DOCUMENTS

| | | | |
|---|---|---|---|
| Re. 27,953 | 3/1974 | Gungle et al. | 313/184 |
| 3,832,587 | 8/1974 | Waymouth et al. | 313/184 |
| 4,161,672 | 7/1979 | Cap et al. | 313/634 |
| 4,612,475 | 9/1986 | Downing | 313/571 |
| 5,117,154 | 5/1992 | Thomas et al. | 313/634 |
| 5,138,227 | 8/1992 | Heider et al. | 313/623 |
| 5,142,195 | 8/1992 | Heider et al. | 313/623 |
| 5,264,759 | 11/1993 | Lewandowski et al. | 313/623 |

*Primary Examiner*—Sandra L. O'Shea
*Assistant Examiner*—Vip Patel
*Attorney, Agent, or Firm*—William H. McNeill

[57] ABSTRACT

A highly loaded, double ended arc lamp has a cylindrical arc chamber with a volume of 56 cc and an arc length of 108 mm. The metal halide fill is limited to amount below 0.6 mg/cc and comprises $HgI_2$; NaI/CsI in a 6:1 weight ratio; and scandium metal. The 2000W lamp is employed for stadium lighting.

6 Claims, 1 Drawing Sheet

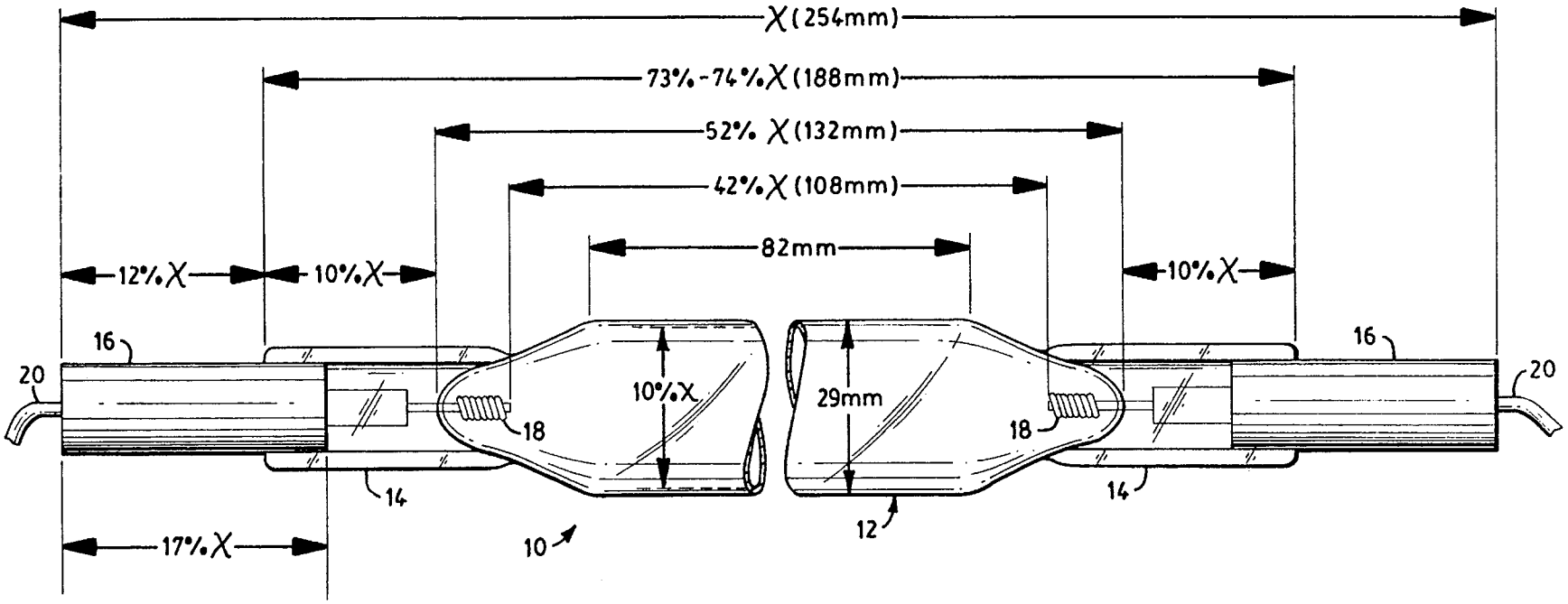
X (254mm)
73%-74%X (188mm)
52% X (132mm)
42%X (108mm)
82mm
29mm
10%X
10%X
10%X
12%X
17%X
10
12
14
14
16
16
18
18
20
20

HEAVILY LOADED DOUBLE-ENDED ARC LAMP

TECHNICAL FIELD

This invention relates to arc discharge lamps and more particularly to double-ended arc discharge carrying a heavy wall loading and suitable for use in reflectors for stadium lighting.

BACKGROUND ART

Floodlighting applications generally require high power light sources that operate in the the 1000 W to 2000 W power range. Arc discharge lamps that are of the double-ended, unjacketed type are suitable for these applications. Such lamps typically have arc lengths ranging from short (i.e., 30 mm) to long (i.e., 180 mm). However, the type most often utilized for sports lighting application is a jacketed light source (e.g., a BT56 outer bulb). The key to the use of unjacketed arc lamps, such as metal halide systems, resides in the ability to closely couple the lamp to the reflector optics of the fixture in which it will by employed. Benefits of using unjacketed double-ended plasma sources as opposed to jacketed products include high fixture efficiencies and reduction of undesirable stray light.

Prior art lamps with short arc lengths (30 mm range) have been developed for use in such situations; however, such lamps have an elliptical arc chamber in which the quartz is gathered and molded using non-standard manufacturing techniques. See, for example, U.S. Pat. Nos. 5,138,227 and 5,142,195. These lamps are expensive to produce. Additionally, the short arc length can induce spotlight characteristics in some optical systems which can cause poor light blending from fixture to fixture. Further, the small lamp size can place the pinch sealed ends in the optical path of the reflector geometry and thus raise the temperature thereof, leading to premature failures.

Long arc lamps, on the other hand, are not as optically efficient in some luminaires, although, obviously, such disadvantages are functions of the reflector designs.

Also, it has been common in the past to used undoped, clear quartz for the lamp envelopes. Such material passes a good deal of ultra violet (UV) light which can generate ozone in the lamp vicinity. Since ozone is quite reactive, this can lead to deterioration of the fixture and fixture components.

DISCLOSURE OF THE INVENTION

It is, therefore, an object of the invention to obviate the disadvantages of the prior art.

It is another object of the invention to enchance stadium lighting.

Yet another object of the invention is to provide an arc lamp that is efficient to manufacture.

These objects are accomplished, in one aspect of the invention, by the provision of a double-ended arc lamp having an overall length equal to X; an arc chamber having a volume of about 56 cc and which is cylindrical for a greater part of its length; an arc length equal to about 42%X; an overall arc chamber length of about 52%X; a maximum arc chamber inside diameter of about 10%X; and a pair of press seals each having a length of about between 10%X to 11%X.

This lamp qualifies as a medium arc length lamp that is easy to manufacture on conventional equipment. The cylindrical arc chamber, long press seal ends and relatively high wall loading, i.e., >14W/cm$^2$, create a lamp having a reasonable wall temperature and press seal temperatures.

Additionally, it is preferred that the lamp be produced from doped quartz to reduce UV emission and thus ozone formation.

BRIEF DESCRIPTION OF THE DRAWINGS

The single FIGURE is a diagrammatic view of a lamp of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

Referring now to the drawing with greater particularity, there is shown in the figure a double-ended arc lamp 10 having an overall length of X. In a preferred embodiment, X is equal to 254 mm. The lamp has an arc chamber 12 which has a volume of about 56 cc and which is cylindrical for a greater part of its length, i.e., about 61% to 62%, or, in the preferred embodiment, 82 mm. The arc chamber has a maximum inside diameter of about 26 mm (i.e., about 10%X) and an outside diameter of 29 mm (T9 tubing). There is a press seal 14 at each end of arc tube 10 having a length of 10%X to 11%X (28 mm). A ceramic end cap 16 is affixed to each of the press seals and projects therebeyond a distance equal to about 12%X. The overall length of the ceramic end caps is about 43 mm, which includes a notched portion for engaging the press seal.

The arc lamp 10 is preferably made from fused quartz containing from 0.01 to 0.02% $TiO_2$ to absorb UV radiation having a wavelength around 185 nm. Such UV emission is known to form ozone in the vicinity of the lamp and the reactiveness of ozone with the fixture materials can deleteriously effect the performance of the lamp. Such glasses are known and are generally referred to as "ozone-free" glasses.

The lamp fill comprises an amount of argon gas at a pressure of 75 torr; an amount of mercury to maintain the operating conditions of the lamp, and, in the preferred embodiment, this amount is about 170 mg. An additive material is also provided for color correction and in the preferred embodiment comprises an amount of material not exceeding 0.6 mg/cc of arc chamber volume. Still more preferably the amount should be between 0.5 and 0.6 mg/cc of arc chamber volume. The additive materials comprise 8 mg $HgI_2$; 25.5 mg NaI/CsI in a 6:1 weight ratio and 1 mg of scandium metal.

This lamp will provide a discharge source with a correlated color temperature of 4000° K. and a color rendering index (CRI) of 65. The luminous efficacy of the lamp is 100 lumens per watt (lpw). For 2000 W operation the lamp will operate at a nominal 250 V using a supply current of 8.5 A.

The electrodes 18 are fabricated from tungsten rod containing 2% thoria and have thereabout a tungsten coil. The electrode tips, and thus the arc length, are 108 mm apart in the preferred embodiment (42%X) and they are sealed in the press seals by means of molybdenum foils, as is well known in the art.

The employment of the CsI helps to lower the wall temperature of the lamp to about 940° C. which greatly increases the life expectancy, which is targeted for 3000 hours. The wall loading of the lamp is about 18 W/cm$^2$.

Flexible lead wires 20 can be provided: however, other forms of termination to fit particular socket configurations can also be used.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A double-ended arc lamp having an overall length equal to X; an arc chamber having a volume of about 56 cc and which is cylindrical for a greater part of its length; an arc length equal to about 42%X; an overall arc chamber length of about 50%X; a maximum arc chamber inside diameter of about 10%X; and a pair of press seals each having a length of about between 10%X to 11%X.

2. The arc lamp of claim 1 wherein said arc chamber and said press seals are fabricated from quartz containing an ultra violet absorbing amount of $TiO_2$.

3. The arc lamp of claim 1 wherein said arc chamber contains an argon starting gas at a pressure of about 75 torr; an amount of mercury to maintain the pressure of the system during operation of the lamp; and an amount of additive material for providing color correction, said amount comprising about 0.5 to 0.6 mg/cc of arc chamber volume.

4. The arc lamp of claim 3 wherein said additive material comprises; about 8 mg $HgI_2$; about 25.5 mg NaI/CsI in a 6:1 weight ratio; and about 1 mg of scandium metal.

5. The arc lamp of claim 4 wherein said lamp operates at a color temperature of 4000° K. and a CRI of about 65.

6. The arc lamp of claim 1 wherein each of said press seals terminates in a ceramic end cap which is affixed to the press seal and projects therebeyond a distance about 12%X.

* * * * *